US008768230B2

(12) United States Patent
Swing et al.

(10) Patent No.: US 8,768,230 B2
(45) Date of Patent: Jul. 1, 2014

(54) METHOD AN APPARATUS FOR REUSING A CLEANING WEB TO CLEAN A FUSER UNIT

(75) Inventors: Jeffrey Nyyssonen Swing, Rochester, NY (US); Christopher Alan Jensen, Rochester, NY (US); Melissa Ann Monahan, Rochester, NY (US); Erwin Ruiz, Rochester, NY (US); Steven Russel, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 119 days.

(21) Appl. No.: 13/524,863

(22) Filed: Jun. 15, 2012

(65) Prior Publication Data

US 2013/0336689 A1 Dec. 19, 2013

(51) Int. Cl.
*G03G 15/20* (2006.01)

(52) U.S. Cl.
USPC ..... 399/327

(58) Field of Classification Search
USPC ..... 399/325, 326, 327
See application file for complete search history.

(56) References Cited

U.S. PATENT DOCUMENTS

| | | | | |
|---|---|---|---|---|
| 5,649,130 | A * | 7/1997 | Nakajima et al. | 399/327 |
| 5,930,574 | A * | 7/1999 | Segawa | 399/327 |
| 7,263,322 | B2 | 8/2007 | Pino et al. | |
| 7,383,007 | B2 * | 6/2008 | Yamada et al. | 399/327 |
| 2007/0053729 | A1 * | 3/2007 | Yamada et al. | 399/327 |
| 2007/0140754 | A1 * | 6/2007 | Poxon et al. | 399/327 |

FOREIGN PATENT DOCUMENTS

| | | | |
|---|---|---|---|
| JP | 01197782 | A * | 8/1989 |
| JP | 04186389 | A * | 7/1992 |
| JP | 04235582 | A * | 8/1992 |

* cited by examiner

*Primary Examiner* — Quana M Grainger
(74) *Attorney, Agent, or Firm* — Ronald E. Prass, Jr.; Prass LLP

(57) ABSTRACT

An approach is provided for reusing a cleaning web to clean portions of a fuser unit. The approach involves causing a cleaning web supply mechanism to feed a cleaning web having a first surface and a second surface to the portions of the fuser unit. The approach also involves causing a cleaning web receiving mechanism to receive the cleaning web following a cleaning process in which the first surface of the cleaning web is used to clean at least one of the portions of the fuser unit. The approach further involves causing the cleaning web receiving mechanism to return the cleaning web to the portions of the fuser unit to clean at least one of the portions of the fuser unit using the second surface of the cleaning web.

16 Claims, 5 Drawing Sheets

METHOD AN APPARATUS FOR REUSING A CLEANING WEB TO CLEAN A FUSER UNIT

FIELD OF DISCLOSURE

The disclosure relates to an apparatus, method, and system for reusing a cleaning web to clean one or more portions of a fuser unit.

BACKGROUND

Conventional fuser units require cleaning and often use a cleaning web made of a fabric or polymer, for example, that can be costly. In conventional fuser units, the cleaning web is used to clean various portions of the fuser unit. For example, the cleaning web in conventional fuser units has two surfaces and is pressed against one or more portions of the fuser unit such as an external heat roll to clean off toner and various contaminants. The cleaning web is often supplied to the fuser unit such that only one surface of the two surfaces of the cleaning web performs the cleaning. After use, the cleaning web must be replaced because the surface of the cleaning web that performs the cleaning is soiled with toner and other contaminants.

SUMMARY

Therefore, there is a need for an approach to reuse a cleaning web to clean one or more portions of a fuser unit.

According to one embodiment, a method for reusing a cleaning web to clean one or more portions of a fuser unit comprises causing, at least in part, a cleaning web supply mechanism to feed a cleaning web having a first surface and a second surface to one or more portions of the fuser unit. The method also comprises causing, at least in part, a cleaning web receiving mechanism to receive the cleaning web following a cleaning process in which the first surface of the cleaning web is used to clean at least one of the one or more portions of the fuser unit. The method further comprises causing, at least in part, the cleaning web receiving mechanism to return the cleaning web to the one or more portions of the fuser unit to clean at least one of the one or more portions of the fuser unit using the second surface of the cleaning web.

According to another embodiment, an apparatus comprises a cleaning web supply mechanism configured to feed a cleaning web having a first surface and a second surface to one or more portions of a fuser unit. The apparatus also comprises a cleaning web receiving mechanism configured to receive the cleaning web following a cleaning process in which the first surface of the cleaning web is used to clean at least one of the one or more portions of the fuser unit. The cleaning web receiving mechanism is configured to return the cleaning web to the one or more portions of the fuser unit to clean at least one of the one or more portions of the fuser unit using the second surface of the cleaning web.

According to another embodiment, a system configured to reuse a cleaning web to clean one or more portions of a fuser unit comprises a cleaning web supply mechanism configured to feed a cleaning web having a first surface and a second surface to one or more portions of a fuser unit. The system also comprises a cleaning web receiving mechanism configured to receive the cleaning web following a cleaning process in which the first surface of the cleaning web is used to clean at least one of the one or more portions of the fuser unit. The cleaning web receiving mechanism is caused to return the cleaning web to the one or more portions of the fuser unit to clean at least one of the one or more portions of the fuser unit using the second surface of the cleaning web.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DETAILED DESCRIPTION

Examples of a method, apparatus, and system for reusing a cleaning web to clean one or more portions of a fuser unit are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term "fuser unit" shall apply to any apparatus having the effect of applying predetermined amounts of heat and/or pressure to a print sheet for any purpose. Typically, in xerographic printing, the fuser unit serves to partially melt powdered toner onto the print sheet, thereby yielding a substantially permanent image. In other applications, applied heat and/or pressure can be used for other specific purposes, such as to level and/or at least partially dry an ink-jet image.

Figure 1:
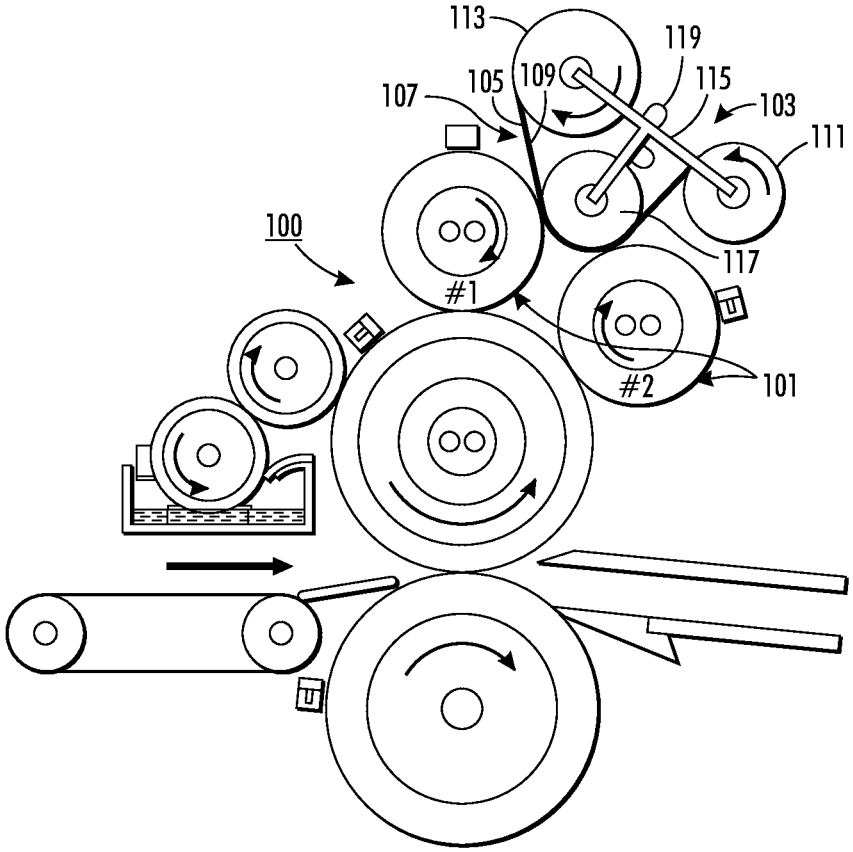
FIG. 1 is a diagram of a system capable of reusing a cleaning web to clean one or more portions of a fuser unit, according to one embodiment.

FIG. 1 is a diagram of a system capable of reusing a cleaning web to clean one or more portions of a fuser unit, according to one embodiment. Conventional fuser units require cleaning and often use a cleaning web made of a fabric or polymer for example that can be costly. In conventional fuser units, the cleaning web is used to clean various portions of the fuser unit. For example, the cleaning web has two surfaces and is pressed against one or more portions of the fuser unit such as an external heat roll to dean off toner and contamination. The cleaning web is often supplied such that only one surface of the two surfaces of the cleaning web performs the cleaning. After use, the cleaning web must be replaced because the surface of the cleaning web that performs the cleaning is soiled with toner and other contaminants. The constant discarding of cleaning webs is bad for the environment because of increased waste. Further, continual discarding of cleaning webs also adds to the costs associated with cleaning a fuser unit.

To address this problem, a system 100 of FIG. 1 introduces the capability to reuse a cleaning web to clean one or more portions of a fuser unit. The system 100 is a fuser unit that requires cleaning following various printing processes. For example, the system 100 has various portions such as rollers 101 that are cleaned, by a cleaning apparatus 103. The fuser unit may have any number of rollers or portions that require cleaning. For discussion purposes, the cleaning apparatus 103 will be referred to as cleaning rollers 101, but the cleaning applications of the cleaning apparatus 103 should not be so limited.

The cleaning apparatus 103 is configured to clean the rollers 101, for example, using a cleaning web 105. The cleaning web 105 has a first surface 107 and a second surface 109. It should be noted that the definition of the first surface and second surface may be interchangeable. For example, the first surface 107 could be considered to be a second surface and the second surface 109 could be considered to be a first surface. For simplicity, however, first surface 107 can be considered to correspond to a surface of the cleaning web 105 that is used to clean a portion of the system 100 such as rollers 101 during a cleaning process first, and the second surface 109 can be considered to correspond to a surface of the cleaning web 105 that is other than the first surface 107.

As discussed above, in the conventional fuser units, once the first surface 107 is used to clean a portion of the fuser unit, the cleaning web 105 is discarded. However, the cleaning apparatus 103 is configured to enable both the first surface 107 and second surface 109 to be used to clean various portions of the system 100. For example, the cleaning apparatus 103 may be configured to reuse the cleaning web 105 such that after the first surface 107 is used to clean the system 100, the second surface 109 is then used in the same, or another cleaning process, such that both the first surface 107 and second surface 109 of the cleaning web 105 may be used before the cleaning web 105 is discarded.

Accordingly, the cleaning web 105 may be completely used and run for at least twice as long as a cleaning web used in a conventional fuser unit before requiring replacement. Such reuse of the cleaning web 105 effectively reduces both waste and overall operating costs of a fuser unit such as system 100.

As shown in FIG. 1, the system 100 comprises rollers 101, cleaning apparatus 103, cleaning web 105, cleaning web supply mechanism 111, cleaning web receiving mechanism 113, cleaning apparatus support 115, and cleaning roller 117.

According to various embodiments, as will be discussed in more detail below, the cleaning apparatus 103 may take many forms. For example, the cleaning apparatus 103 may be a cartridge, such as that illustrated in FIG. 1, having at least a cleaning web supply mechanism 111, a cleaning web receiving mechanism 113, and optionally having the cleaning apparatus support 115. In FIG. 1, the cleaning web supply mechanism 111 is a roller configured to accommodate a spool of cleaning web 105. The cleaning web 105 may be unwound from the cleaning web supply mechanism 111 either clockwise or counter-clockwise as it is fed to one or more cleaning regions such as any nip portion between cleaning roller 117 and rollers 101, for example. Following a cleaning process that uses the cleaning web 105, the cleaning web 105 is received by the cleaning web receiving mechanism 113. In FIG. 1, the cleaning web receiving mechanism 113 is a roller that is configured to wind the cleaning web 105 after the first surface 107 of the cleaning web 105 is used to clean rollers 101. The cleaning web receiving mechanism 113, if embodied as a roller, may wind the cleaning web 105 either clockwise or counter-clockwise.

According to various embodiments, the cleaning web supply mechanism 111 and cleaning web receiving mechanism 113, if configured as rollers, for example, may be interchangeable such that once the cleaning web supply mechanism 111 is depleted, or caused to cease supplying cleaning web 105, the cleaning web supply mechanism 111 may be removed from its supply position and swapped with the cleaning web receiving mechanism 113, which may also be removed from its receiving position, now that the receiving mechanism 113 has a partially used cleaning web 105 with a dirty first surface 107. The repositioning of the cleaning web supply mechanism 111 and the cleaning web receiving mechanism 113, in this embodiment, enables the second surface 109 of the cleaning web 105 to be used for a next cleaning process.

Once swapped, the cleaning web receiving mechanism 113 having the partially used cleaning web 105 with a dirty first surface 107 now becomes the cleaning web supply mechanism 111 and the original cleaning web supply mechanism 111 that is now in place of the original cleaning web receiving mechanism 113 is configured to receive the cleaning web 105 after it is used to clean one or more portions of the system 100 using the second surface 109. The one or more portions of the system 100 that are to be cleaned may be the same or different from the one or more portions of the fuser unit such as rollers 101 that are subject to a same or different cleaning process.

When the cleaning web receiving mechanism 113 replaces the cleaning web supply mechanism 111, if embodied as a roller, is caused to unwind such that the second surface 109 of the cleaning web 105 is used to clean the system 100, as discussed above.

In one or more embodiments, the cleaning web supply mechanism 111 and cleaning web receiving mechanism 113 may be independent of one another such that they may be removed from the system 100, installed into the system 100, and/or repositioned/rotated separately. Alternatively, the cleaning web supply mechanism 111 and cleaning web receiving mechanism 113 may be incorporated into a cleaning apparatus 103 that is embodied as a cartridge, for example. A cartridge-type cleaning apparatus 103 is illustrated in FIG. 1. The cartridge-type cleaning apparatus 103 connects and supports the cleaning web supply mechanism 111 and cleaning web receiving mechanism 113, and optionally supports cleaning roller 117, by way of cleaning apparatus support 115.

According to various embodiments, the cleaning apparatus support 115 enables at least the cleaning web supply mechanism 111 and cleaning web receiving mechanism 113, and optionally the cleaning roller 117, to be removed and installed together to and from the system 100. For example, when the cleaning web 105 is wound by the cleaning web receiving mechanism 113 after the first surface 107 of the cleaning web 105 is soiled, and the cleaning web supply mechanism 111 is depleted, or caused to cease supplying cleaning web 105, the cartridge-type cleaning apparatus 103 may be removed from the system 100, inverted such that the cleaning web supply mechanism 111 and cleaning web receiving mechanism 113 switch positions, and re-installed into the system 100 such that the cleaning web receiving mechanism 113 having a wound cleaning web 105 with a soiled first surface 107 becomes the cleaning web supply mechanism 111 that is configured to supply cleaning web 105 to clean or more portions of the system 100 using the second surface 109, and the original cleaning web supply mechanism 111 is now in a position to be the cleaning web receiving mechanism 113 and receive the cleaning web 105 after the second surface 109 is used to clean rollers 101, for example.

According to various embodiments, the cleaning apparatus support 115 may comprise any materials such as stainless steel, carbon fiber, ceramic, polymer, etc., or any combination thereof. Additionally, to facilitate one or more of removal, inversion, and install of the cleaning apparatus 103, the cleaning apparatus 103 may further comprise one or more handles 119. Because temperatures in the system 100 may reach or exceed 400° F., the one or more handles 119, according to various embodiments, may comprise any material whether it be the same or different from the cleaning apparatus support 115, and/or a material that exhibits heat resistance such that an operator that may remove, invert, and install the cleaning apparatus 103 may avoid being burned.

In alternative embodiments, as will be discussed in more detail below, the cleaning web receiving mechanism 113 may be configured to reroute the cleaning web 105 such that the second surface 109 of the cleaning web 105 may be used to perform the same or another cleaning process after the first surface 107 is used. Or, the cleaning web receiving mechanism 113, if embodied as a roller, may be configured to be removed, installed in its original position, inverted, unwound in a direction opposite that which the cleaning web 105 was wound by the cleaning web receiving mechanism 113, and run through the system 100 in reverse such that the second surface 109 of the cleaning web 105 may be used to perform the same or another cleaning process after the first surface 107 is used. The cleaning web supply mechanism 111, accordingly, need not be removed from the system 100 and need only be respooled so that the cleaning web supply mechanism 111 may become the cleaning web receiving mechanism 113 and wind the cleaning web 105 after the second surface 109 is used to clean one or more portions of the system 100.

Figure 2:
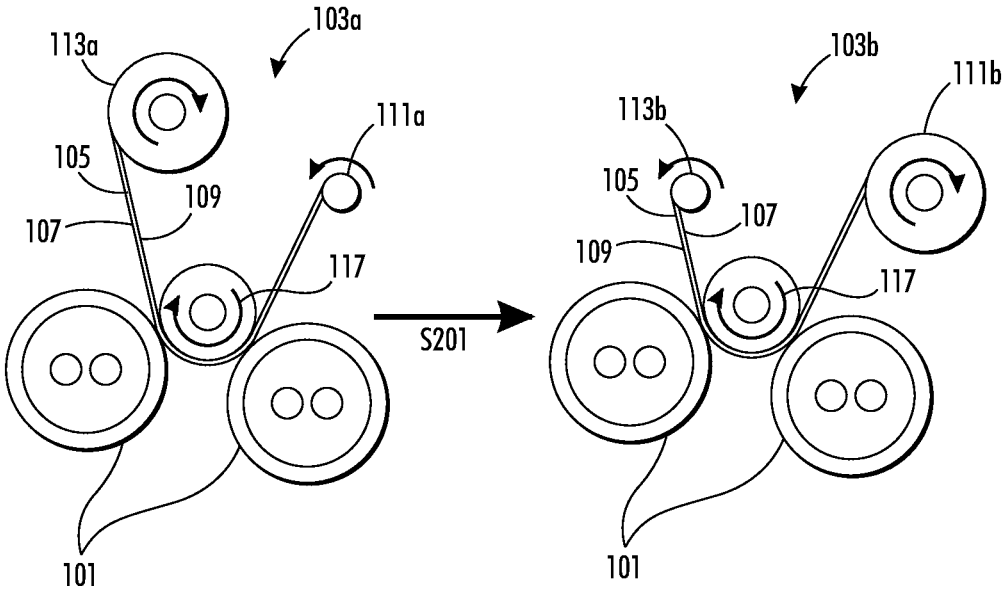
FIG. 2 is a diagram of a transitioning of a cleaning apparatus, according to one embodiment.

FIG. 2 is a diagram of an example embodiment of the cleaning apparatus 103. In this example, the cleaning apparatus 103 transitions from cleaning apparatus 103*a* to cleaning apparatus 103*b* pursuant to step S201. The cleaning apparatus 103*a* cleans rollers 101 with cleaning web 105. Cleaning web 105 is provided by cleaning web supply mechanism 111*a*, which in this example is a roller, such that the first surface 107 is used to clean rollers 101 as the cleaning web 105 is fed through nips that occur between the rollers 101 and the cleaning roller 117. The second surface 109 of the cleaning web 105 is not soiled by inks or contaminants in the same manner as the first surface 107, if at all. The cleaning web receiving mechanism 113*a* receives the cleaning web 105 after first surface 107 of the cleaning web 105 is used to clean the rollers 101. The cleaning web receiving mechanism 113*a*, in this embodiment, is a roller that is configured to wind the cleaning web 105. Once the cleaning web 105 is depleted, or is ceased to be supplied by the cleaning web supply mechanism 111*a*, the cleaning apparatus 103*a* is adjusted in step S201 such that the cleaning web receiving mechanism 113*a* is any of, simply swapped and/or inverted with the cleaning web supply mechanism 111*a* such that the cleaning web receiving mechanism 113*a*, now having a wound, partially used, cleaning web 105, becomes cleaning web supply mechanism 111*b*. Accordingly, cleaning web supply mechanism 111*a* may become cleaning web receiving mechanism 113*b*, or a different roller may be used as cleaning web receiving mechanism 113*b* if the roller may be separately removed and installed into the system 100.

As discussed above, the cleaning web supply mechanism 111 and cleaning web receiving mechanism 113 may be independently removed and reinstalled into the system 100 discussed above, or maybe configured such that they are supported together as a cartridge to facilitate the swapping that occurs in step S201.

One swapped, the cleaning web 105 may be re-fed through the system 100 such that the second surface 109 is used to clean rollers 101 and the cleaning web 105 is received by the cleaning web receiving mechanism 113*b* (which may have been the cleaning web supply mechanism 111*a*).

Figure 3:
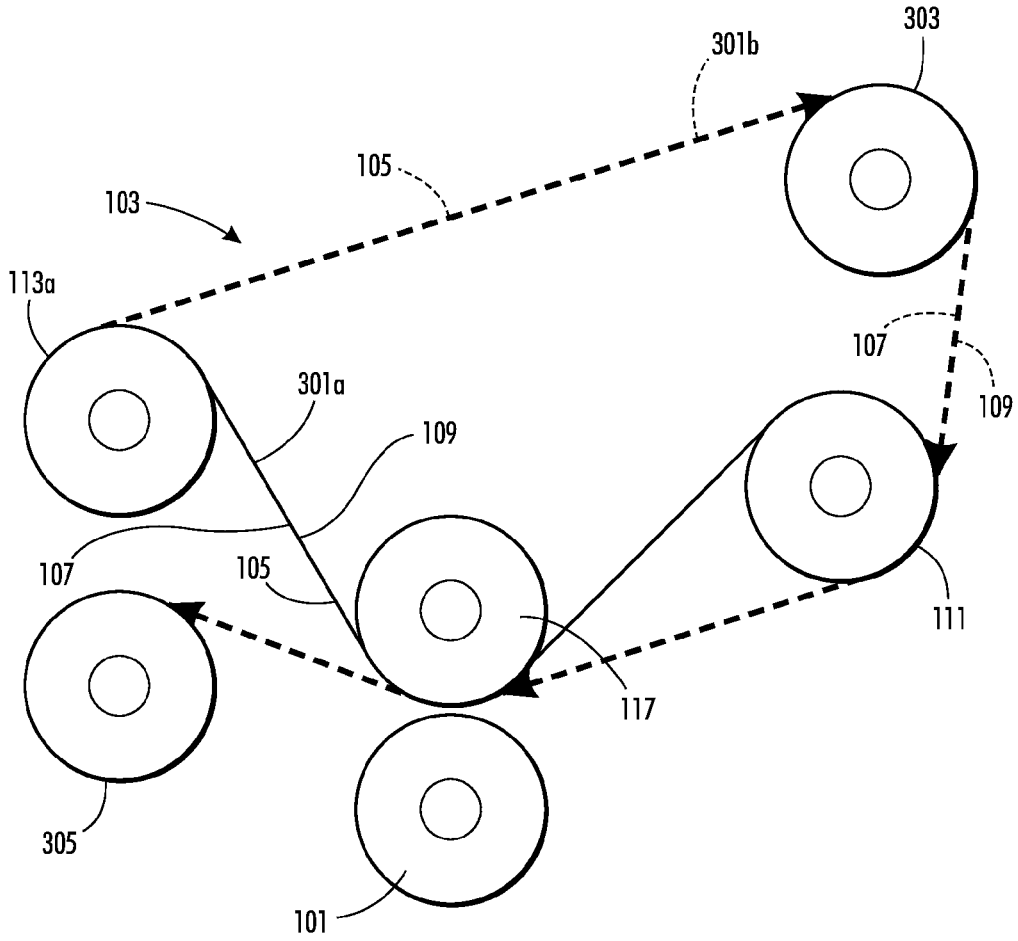
FIG. 3 is a diagram of a rerouting cleaning apparatus, according to one embodiment.

FIG. 3 is an example embodiment of a cleaning apparatus 103 configured to reroute the cleaning web 105 after the first surface 107 of the cleaning web 105 is used to clean roller 101. For example, cleaning web 105 may be supplied by cleaning web supply mechanism 111 to clean roller 101 with the first surface 107 of the cleaning web 105. Cleaning web 105, when cleaning roller 101 with the first surface 107 travels along path 301*a* to cleaning web receiving mechanism 113*a*, second surface 109 of cleaning web 105 is not soiled with any ink or contaminants in the same manner as the first surface of the cleaning web 105, if at all. Cleaning web receiving mechanism 113*a* is illustrated in this example is a roller that winds the cleaning web 105 after it is used to clean the roller 101 with the first surface 107. Alternatively, the cleaning web receiving mechanism 113*a* can be any means that may reroute the cleaning web 105 to secondary path 301*b*. Once the cleaning web 105 is depleted from the cleaning web supply mechanism 111 or is ceased to be supplied by the cleaning web supply mechanism 111, the cleaning web receiving mechanism 113*a* may either cause the cleaning web 105 to be rerouted to the secondary travel path 301*b*, or may require the cleaning web 105 to be re-fed through the system 100, discussed above, such that roller 101 may be cleaned.

In either case, the rerouting of the cleaning web 105 from travel path 301*a* to travel path 301*b* may be facilitated by any number of features such as additional rollers 303, or guides, for example. The rerouting of the cleaning web 105 enables the first surface 107 and second surface 109 to effectively switch between travel path 301*a* and travel path 301*b* such that when the cleaning web 105 is fed through a nip formed between cleaning roller 117 and roller 101, the second surface 109 of the cleaning web 105 is used to clean the roller 101 and not the first surface 107, as had been done on travel path 301*a*.

According to various embodiments, a cleaning apparatus 103 that is configured to reroute the cleaning web 105 may have a second cleaning web receiving mechanism 305 engaged when cleaning web 105 is on travel path 301*b* configured to receive the cleaning web 105 after both the first surface 107 and second surface 109 are used to clean the roller 101, for example.

Figure 4:
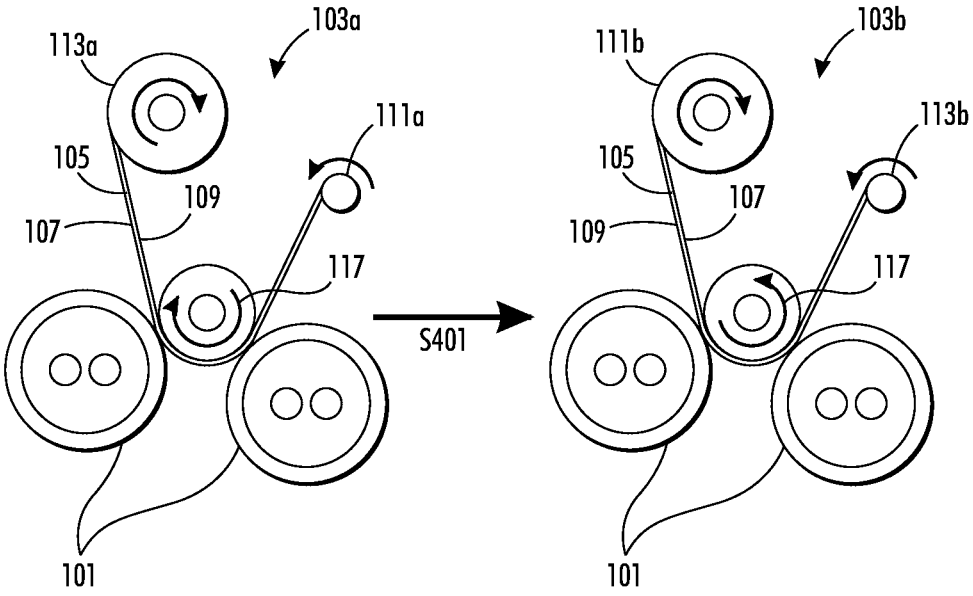
FIG. 4 is a diagram of a transitioning of a cleaning apparatus, according to one embodiment.

FIG. 4 is a diagram of an example embodiment of the cleaning apparatus 103, discussed above. In this example, the cleaning apparatus 103 transitions from cleaning apparatus 103*a* to cleaning apparatus 103*b* pursuant to step S401. The cleaning apparatus 103*a* cleans rollers 101 with cleaning web 105. Cleaning web 105 is provided by cleaning web supply mechanism 111*a*, which in this example is a roller, such that the first surface 107 is used to clean rollers 101 as the cleaning web 105 is fed through nips that occur between the rollers 101 and the cleaning roller 117. The second surface 109 of the cleaning web 105 is not soiled by inks or contaminants in the same manner as the first surface 107, if at all. The cleaning web receiving mechanism 113*a* receives the cleaning web 105 after first surface 107 of the cleaning web 105 is used to clean the rollers 101. The cleaning web receiving mechanism 113*a*, in this embodiment, is a roller that is configured to wind the cleaning web 105. Once the cleaning web 105 is depleted, or is ceased to be supplied by the cleaning web supply mechanism 111*a*, the cleaning apparatus 103*a* is adjusted in step S401 such that the cleaning web receiving mechanism 113*a* is removed and reversed 180 degrees such that it is installed into the system 100 backwards. Accordingly, cleaning web receiving mechanism 113*a* becomes cleaning web supply mechanism 111*b*.

Once the cleaning web receiving mechanism 113*a* is reversed and becomes cleaning web supply mechanism 111*b*, the cleaning web 105 may be re-fed through the system 100 such that the second surface 109 is used to clean rollers 101 and the cleaning web 105 is received by the cleaning web receiving mechanism 113*b* (which may have been the cleaning web supply mechanism 111*a*). The cleaning apparatus 103*b* is then caused to feed the cleaning web 105 in a direction opposite the direction cleaning web 105 was run through the system 100 when cleaning rollers 101 with the first surface 107 so that second surface 109 of the cleaning web 105 is used to clean rollers 101.

As discussed above, the cleaning apparatus 103 may be used to clean any number of portions of the system 100, discussed above, and should not be limited to single or plural rollers 101, that are discussed throughout these examples. Additionally, the cleaning roller 117 should be considered to be representative of any number of cleaner rollers that may cause a cleaning nip between any cleaning roller 117 and any portion of the system 100 days to be cleaned by the cleaning web 105.

Figure 5:
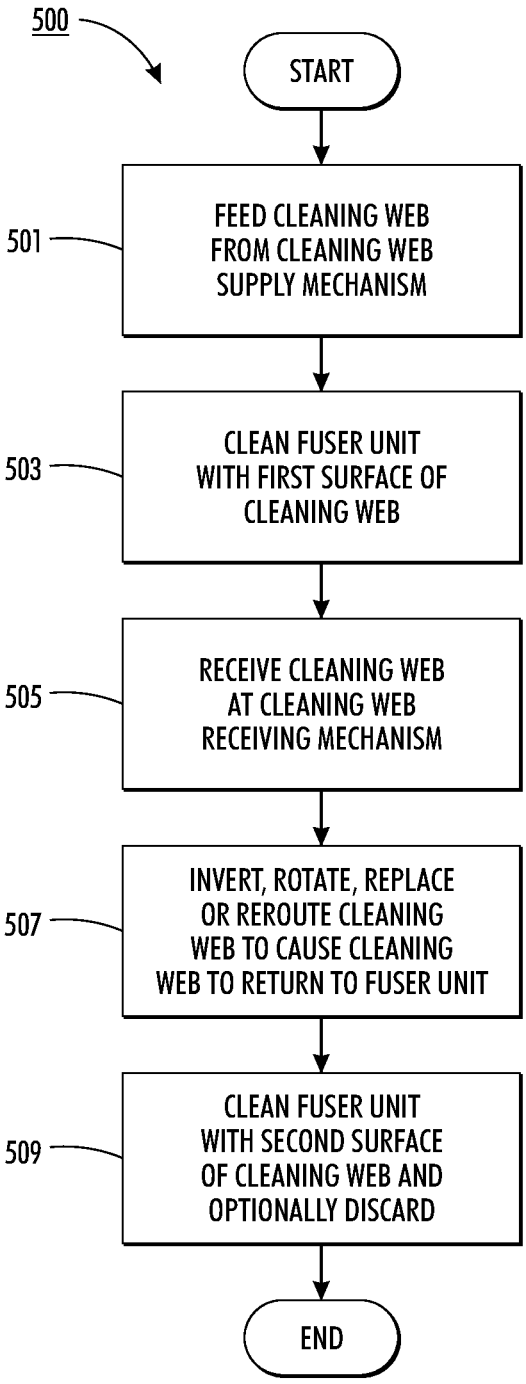
FIG. 5 is a flowchart of a process for reusing a cleaning web to clean one or more portions of a fuser unit, according to one embodiment.

FIG. 5 is a flowchart of a process for reusing a cleaning web to clean one or more portions of a fuser unit, according to one embodiment. In step 501, a cleaning web supply mechanism such as cleaning web supply mechanism 111 is caused to feed a cleaning web 105 having a first surface 107 and a second surface 109 to one or more portions of the fuser unit such as rollers 101, discussed above. The process continues to step 503 in which the rollers 101 are caused to be cleaned by the first surface 107 of the cleaning web 105. Then, in step 505, a cleaning web receiving mechanism such as cleaning web receiving mechanism 113 discussed above Is caused to receive the cleaning web following a cleaning process in which the first surface 107 of the cleaning web 105 is used to clean at least one of the one or more portions of the fuser unit.

Next, in step 507, the cleaning web receiving mechanism 113 is caused to return the cleaning web 105 to the one or more portions of the fuser unit, which may or may not be limited to rollers 101, or any other portions of the fuser unit that may have been cleaned by the first surface 107 of the cleaning web 105 to clean at least one of the one or more portions of the fuser unit using the second surface 109 of the cleaning web 105. For example, the cleaning web supply mechanism 111 may be a roller configured to accommodate a roll of cleaning web, or it may be a portion of a cleaning web feeding apparatus that provides a continuous feed of cleaning web to the fuser unit. According to various embodiments, as discussed above, the cleaning web receiving mechanism 113 may be a roller configured to wind the cleaning web 105 following the cleaning process discussed above, or accommodate the cleaning web 105 having a soiled first surface 107 and reroute the cleaning web 105 such that the second surface 109 may be used to clean various portions of the fuser unit.

According to various embodiments, the cleaning web supply mechanism 111 and cleaning web receiving mechanism 113 may be caused to be interchanged with one another to cause, at least in part, the second surface 109 of the cleaning web 105 to be used to clean at least one of the one or more portions of the fuser unit. Or, the cleaning web receiving mechanism 113 may cause, as discussed above, the cleaning web 105 to be rerouted such that the second surface 109 of the cleaning web 105 is used to clean at least one of the one or more portions of the fuser unit.

According to various embodiments, the cleaning web supply mechanism 111 and the cleaning web receiving mechanism 113 may be configured to be installed together as a cartridge, and together rotated to cause the second surface 109 of the cleaning web 105 to be used to clean at least one of the one or more portions of the fuser unit. The cartridge, for example may have at least one support configured to hold the cleaning web supply mechanism 111 which may be a roller and the cleaning web receiving mechanism 113, which may also be a roller, together. Additionally, as discussed above, a cartridge-type cleaning apparatus 103 may have at least one handle configured to facilitate the rotation of the cartridge. Alternatively, the cleaning web supply mechanism 111 and cleaning web receiving mechanism 113 may be independent such that only the cleaning web receiving mechanism 113 may be selectively removed and have its orientation reversed such that the cleaning web receiving mechanism 113 may become a cleaning web supply mechanism 111 and feed the cleaning web 105 back through the system 100 in a direction opposite that which the cleaning web 105 was originally fed during which the first surface 107 of the cleaning web 105 was used to clean the fuser unit such that the second surface 109 of the cleaning web 105 may be used to clean the fuser unit.

The process continues to step 509 in which the cleaning web 105 is fed through the fuser unit such that the second surface 109 is caused to clean the fuser unit, and the cleaning web may then be discarded once both the first surface 107 and second surface 109 are used to clean the fuser unit at least once. In one or more embodiments, the first surface 107 and second surface 109, though conventionally only used once, may be assessed for a level of dirtiness, and if the level of dirtiness is not above a predetermined threshold, reused any number of times until the cleaning web 105 is to be discarded.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. An apparatus useful in printing comprising:

a cleaning web supply mechanism configured to feed a cleaning web having a first surface and a second surface to one or more portions of a fuser unit; and a cleaning web receiving mechanism configured to receive the cleaning web following a cleaning process in which the first surface of the cleaning web is used to clean at least one of the one or more portions of the fuser unit, wherein the cleaning web receiving mechanism is configured to return the cleaning web to the one or more portions of the fuser unit to clean at least one of the one or more portions of the fuser unit using the second surface of the cleaning web, wherein the cleaning web supply mechanism is a roller configured to accommodate a roll of cleaning web, wherein the cleaning web receiving mechanism is a roller configured to wind the cleaning web following the cleaning process, wherein the cleaning web supply mechanism and cleaning web receiving mechanism are interchangeable with one another to cause, at least in part, the second surface of the cleaning web to be used to clean at least one of the one or more portions of the fuser unit.

2. The apparatus of claim 1, wherein the cleaning web receiving mechanism is configured to have its orientation in the fuser unit reversed to cause, at least in part, the second surface of the cleaning web to be used to clean at least one of the one or more portions of the fuser unit when the cleaning web is fed through the fuser unit by the cleaning web receiving mechanism in a direction opposite a direction in which the cleaning web was fed by the cleaning web supply mechanism to the one or more portions of the fuser unit.

3. The apparatus of claim 1, wherein the cleaning web receiving mechanism is configured to cause, at least in part, the cleaning web to be rerouted such that the second surface of the cleaning web is used to clean at least one of the one or more portions of the fuser unit.

4. The apparatus of claim 1, wherein the cleaning web supply mechanism and the cleaning web receiving mechanism are configured to be installed together as a cartridge.

5. The apparatus of claim 4, wherein the cartridge is configured to be rotated to cause, at least in part, the second surface of the cleaning web to be used to clean at least one of the one or more portions of the fuser unit.

6. The apparatus of claim 5, wherein the cleaning web supply mechanism is a roller, the cleaning web receiving mechanism is a roller, and the cartridge comprises at least one support configured to hold the cleaning web supply mechanism and the cleaning web receiving mechanism together.

7. The apparatus of claim 4, wherein the cartridge comprises at least one handle configured to facilitate the rotation of the cartridge.

8. The apparatus of claim 7, wherein the at least one handle comprises a heat resistant material.

9. A method for reusing a cleaning web to clean one or more portions of a fuser unit, the method comprising:

causing, at least in part, a cleaning web supply mechanism to feed a cleaning web having a first surface and a second surface to one or more portions of the fuser unit;

causing, at least in part, a cleaning web receiving mechanism to receive the cleaning web following a cleaning process in which the first surface of the cleaning web is used to clean at least one of the one or more portions of the fuser unit; and causing, at least in part, the cleaning web receiving mechanism to return the cleaning web to the one or more portions of the fuser unit to clean at least one of the one or more portions of the fuser unit using the second surface of the cleaning web;

wherein the cleaning web supply mechanism is a roller configured to accommodate a roll of cleaning web, wherein the cleaning web receiving mechanism is a roller configured to wind the cleaning web following the cleaning process, causing, at least in part, the cleaning web supply mechanism and cleaning web receiving mechanism to be interchanged with one another to cause, at least in part, the second surface of the cleaning web to be used to clean at least one of the one or more portions of the fuser unit.

10. The method of claim 9, further comprising:

causing, at least in part, the cleaning web receiving mechanism to change its orientation in the fuser unit to cause, at least in part, the second surface of the cleaning web to be used to clean at least one of the one or more portions of the fuser unit when the cleaning web is fed through the fuser unit by the cleaning web receiving mechanism in a direction opposite a direction in which the cleaning web was fed by the cleaning web supply mechanism to the one or more portions of the fuser unit.

11. The method of claim 9, causing, at least in part, the cleaning web receiving mechanism to cause, at least in part, the cleaning web to be rerouted such that the second surface of the cleaning web is used to clean at least one of the one or more portions of the fuser unit.

12. The method of claim 9, wherein the cleaning web supply mechanism and the cleaning web receiving mechanism are configured to be installed together as a cartridge.

13. The method of claim 12, further comprising:

causing, at least in part, the cartridge is to be rotated to cause, at least in part, the second surface of the cleaning web to be used to clean at least one of the one or more portions of the fuser unit.

14. The method of claim 13, wherein the cleaning web supply mechanism is a roller, the cleaning web receiving mechanism is a roller, and the cartridge comprises at least one support configured to hold the cleaning web supply mechanism and the cleaning web receiving mechanism together.

15. The method of claim 13, wherein the cartridge comprises at least one handle configured to facilitate the rotation of the cartridge.

16. A system configured to reuse a cleaning web to clean one or more portions of a fuser unit, the system comprising:

a cleaning web supply mechanism configured to feed a cleaning web having a first surface and a second surface to one or more portions of a fuser unit; and a cleaning web receiving mechanism configured to receive the cleaning web following a cleaning process in which the first surface of the cleaning web is used to clean at least one of the one or more portions of the fuser unit, wherein the cleaning web receiving mechanism is caused to return the cleaning web to the one or more portions of the fuser unit to clean at least one of the one or more portions of the fuser unit using the second surface of the cleaning web, wherein the cleaning web supply mechanism is a roller configured to accommodate a roll of cleaning web, wherein the cleaning web receiving mechanism is a roller configured to wind the cleaning web following the cleaning process, wherein the cleaning web supply mechanism and cleaning web receiving mechanism are interchangeable with one another to cause, at least in part, the second surface of the cleaning web to be used to clean at least one of the one or more portions of the fuser unit.

* * * * *